United States Patent [19]

Chermin et al.

[11] 4,039,895

[45] Aug. 2, 1977

[54] DEVICE FOR STARTING AND FEEDING A DISCHARGE LAMP

[75] Inventors: Hubertus Mathias Jozef Chermin; Meerten Luursema; Jaap Rozenboom; Herman Adrianus Godefridus Smulders, all of Eindhoven, Netherlands

[73] Assignee: U.S. Philips Corporation, New York, N.Y.

[21] Appl. No.: 657,064

[22] Filed: Feb. 11, 1976

[30] Foreign Application Priority Data

Feb. 21, 1975 Netherlands ..... 7502005

[51] Int. Cl.[2] ..... H05B 41/232

[52] U.S. Cl. ..... 315/101; 315/106; 315/205; 315/DIG. 2

[58] Field of Search ..... 315/94, 101, 105, 106, 315/200 R, 205, DIG. 2, DIG. 5

[56] References Cited

U.S. PATENT DOCUMENTS 3,857,060 12/1974 Chermin ..... 315/101 X
3,875,459 4/1975 Remery et al. ..... 315/105 X
3,919,590 11/1975 Remery et al. ..... 315/DIG. 5

FOREIGN PATENT DOCUMENTS 2,122,411 11/1972 Germany ..... 315/101

*Primary Examiner*—Eugene R. La Roche
*Attorney, Agent, or Firm*—Frank R. Trifari; Bernard Franzblau

[57] ABSTRACT

A device for starting a discharge lamp by means of a transistor starter provided with an auxiliary transistor for stopping the starting procedure if the lamp fails to ignite.

A zener diode is included in the control circuit of the auxiliary transistor, a capacitor is connected in parallel across the lamp, and a self-inductor is included in the connection from the lamp to the main transistor. The auxiliary transistor has a second function in that, by the action of the zener diode, the auxiliary transistor delays the conduction of the main transistor so that a large rise of the voltage between the lamp electrodes is produced, which provides a more reliable ignition of the lamp within a large temperature range.

11 Claims, 2 Drawing Figures

DEVICE FOR STARTING AND FEEDING A DISCHARGE LAMP

The invention relates to a device for starting and operating a gas- and/or discharge lamp which is provided with two electrodes, the device being provided with two input terminals which are intended for connection to an AC voltage source; whose frequency is less than 100Hz, the two input terminals- during starting and operation of the lamp- being interconnected by means of a series circuit including at least a stabilizing inductor and the lamp. The two lamp electrodes are interconnectecd by a starter comprising a first semiconductor switching element, while parallel to a branch which comprises said semiconductor switching element a control circuit for the first semiconductor switching element is provided. This control circuit comprises at least a first capacitor, an auxiliary transistor of the starter shunting at least the first capacitor, while the base of the auxiliary transistor is connected to a control circuit, namely to a junction of a first resistor and a second capacitor which are connected in series and which are parallel-to the branch comprising the first semiconductor switching element.

Figure 1:
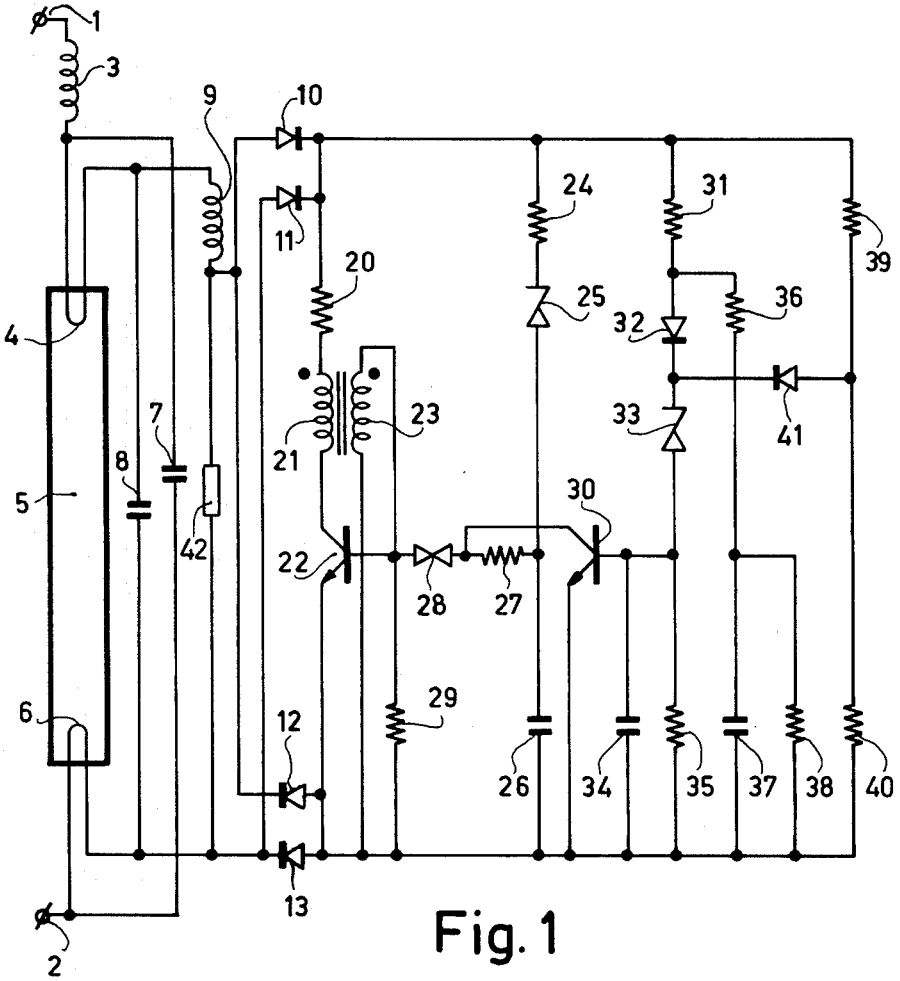

A known device of the said type is shown in FIG. 1 of U.S. Pat. No. 3,875,459. An advantage of that known device is that if the lamp refuses to ignite, the auxiliary transistor stops, after a given time, the efforts to start the lamp. However, a disadvantage of that known device is that the voltage peaks which are generated to start the discharge lamp, show a relatively large and fairly constant amplitude, This entails, namely, that the first semiconductor switching element must be able to withstand these voltage peaks in its non-conducting state.

A further disadvantage of that known device is that if the relatively large amplitude of the voltage peaks is still too small to start the discharge lamp, the lamp will not ignite.

A object of the invention is to make it possible for a device of the above mentioned type to rate the first semiconductor switching element for a relatively low, permissible blocking voltage of a somewhat longer duration; but, furthermore, if the lamp is difficult to start, to generate one or a few brief voltage peak(s) of a large amplitude.

A device according to the invention for starting and operating a gas — and/or vapour discharge lamp provided with two electrodes, includes two input terminals which are intended for connection to an AC voltage source whose frequency is less than 100Hz. The two input terminals —during starting and operation of the lamp — are interconnected by means of a series circuit comprising at least a stabilizing inductor and the lamp, the two lamp electrodes being interconnected by means of a starter comprising a first semiconductor switching element. A control circuit for the first semiconductor switching element is provided in parallel to a branch which comprises said semiconductor switching element. This control circuit comprises at least a first capacitor with an auxiliary transistor of the starter shunting at least the first capacitor. The base of the auxiliary transistor is connected to a second control circuit, namely to a junction of a resistor and a second capacitor which are connected in series and which are in parallel to the branch comprising the first semiconductor switching element. The invention is characterized in that the base of the auxiliary transistor is connected via a voltge-sensitive threshold element to the junction of the resistor and the second capacitor, the lamp electrodes are connected by means of a third capacitor, and that a second inductor is included in the connection of the lamp electrodes to the first semiconductor switching element.

An advantage of this device is that, by means of the voltage-sensitive threshold element incorporated in the control circuit of the auxiliary transistor, the instant at which the first semiconductor switching element starts conducting — a short while after the device has been switched on — can be influenced. This makes it possible to control the degree to which the voltage between the lamp electrodes can be raised during the ignition of the lamp. This control is such that the instant at which the first semiconductor switching element starts conducting is somewhat delayed so that the rise in voltage across the series circuit of the third capacitor and the second inductor, — and consequently the voltage acros the lamp which is available for starting — is increased.

So the invention is in fact based on the idea to use the auxiliary transistor — when the lamp definitely refuses to ignite — nct only for stopping the attempts to start the lamp by short circuiting the first capacitor, but also to use that auxiliary transistor during the starting procedure of the lamp. This is effected by rendering the auxiliary transistor conductive one or more times for a short period before the end of the starting procedure so that charging of the first capacitor in the control circuit of the semiconductor switching element is counteracted. This implies that it takes longer before the first capacitor has obtained a voltage sufficient to make the semiconductor switching element conductive. As observed before, this delay results in a larger rise of the voltage across the lamp.

However, it takes some time after the device has been switched on for the auxiliary transistor to start conducting. The reason is the presence of the voltage-sensitive threshold element in the control circuit of the auxiliary transistor. If, after some time, the second capacitor is charged to such an extent that it causes the auxiliary transistor to become conductive, the delay in making the first semiconductor switching element conductive becomes operative.

As far as the rise in voltage across the discharge lamp — during the starting procedure — is concerned, it should be noted that this is known per se from British Patent Specification No. 1,208,489. In that case, however, the instant at which the semiconductor switching element is made conductive is not variable.

The discharge lamp may, for example, be a lamp which is not provided with preheatable electrodes, for example a high pressure metal vapour discharge lamp.

The discharge lamp is preferably a lamp provided with preheatable electrodes, for example a low-pressure mercury vapour discharge lamp. The current which flows through the semiconductor switching element during the starting procedure can then also be used to preheat the lamp electrodes.

The first semiconductor switching element consists, for example of two thyristors which are connected in anti-parallel. The first semiconductor switching element may also be, for example, a "triac", i.e., a semiconductor switching element having a bidirectional thyristor characteristic.

In a preferred embodiment of a device according to the invention a diode bridge is included between the lamp electrodes and the first semiconductor switching element, this semicondutor switching element being a transistor which is located in a center branch of the diode bridge.

An advantage of this preferred embodiment is that only a simple semiconductor switching element is required and that furthermore a number of small voltage peaks can be produced across the lamp during each half cycle of the supply voltage.

The voltage-sensitive threshold element in the control circuit of the auxiliary transistor may, for example, be a neon glow discharge lamp.

In a further preferred embodiment of a device according to the invention the voltage-sensitive threshold element is a first zener diode.

An advantage of this preferred embodiment is that, for example, the threshold voltage of the threshold element varies, very little in the course of time.

In a following preferred embodiment according to the invention the control circuit of the auxiliary transistor comprises a series connection of, in this sequence, the resistor, a first diode, a first zener diode and a fourth capacitor with the pass directions of the first diode and the zener diode pointing to one another. The series circuit of the first diode the first zener diode and the fourth capacitor is shunted by a series circuit of a second resistor and the second capacitor, while the second capacitor and also the fourth capacitor are each shunted by a resistor.

An advantage of the last-mentioned preferred device according to the invention is that by means of this special control circuit for the auxiliary transistor it is ensured that the auxiliary transistor can be switched to the conducting and non-conducting state various times during each half cycle of the supply voltage. This is caused inter alia by the fact that now the second capacitor can first be charged via the first and the second resistor, whereafter this second capacitor makes the auxiliary transistor conductive via the first diode and the blocking direction of the first zener diode. Owing to the fact that the voltage across the branch which comprises the first semiconductor switching element shows an oscillation, the voltage across the series circuit of the second resistor and the second capacitor will fall shortly thereafter to below the threshold voltage of the first zener diode. As a result the auxiliary transistor becomes non-conductive. As the frequency of the aforementioned voltage across the branch which contains the first semiconductor element is as a rule higher than the frequency of the main supply, it is possible to repeat the procedure, outlined above, for switching the auxiliary transistor to the conducting and non-conducting state several times each half cycle of the main supply.

The last-mentioned preferred embodiment may be further improved by adding, to the control circuit of the auxiliary transistor, a non-capacitive voltage divider which is connected in parallel to the branch which comprises the first semiconductor switching element. The tap of this voltage divider is connected via a second diode to the junction of the first diode and the zener diode, the pass direction of the second diode pointing towards the last-mentioned junction.

An advantage of this last improvement is that if the voltage across the first semiconductor switching element would attain a high value very rapidly, a current will flow via the non-capacitive voltage divider and the second diode into the blocking direction of the zener diode which will rapidly make the auxiliary transistor conductive. The first capacitor is then practically short-circuited which prevents the first semiconductor switching element from becoming conductive again. Namely if the first semiconductor switching element, constructed as a transistor, would become conductive at that instant, this might be disastrous with such a high voltage across its main electrodes.

In a further preferred embodiment of a device according to the invention a second voltage-sensitive threshold element is connected in the branch which contains the first capacitor and which is connected in parallel to the first semiconductor switching element.

An advantage of this preferred embodiment is that, quite irrespective of the auxiliary transistor and its control circuit, a delay in the instant at which the first semiconductor switching element becomes conductive is already obtained by means of the second voltage-sensitive threshold element, which results in a somewhat higher rise of the voltage-sensitive threshold element is that this element is also used to interrupt the starter operation as soon as the lamp has been started. For that purpose the threshold voltage must be above the operating voltage of the discharge lamp.

Figure 2:
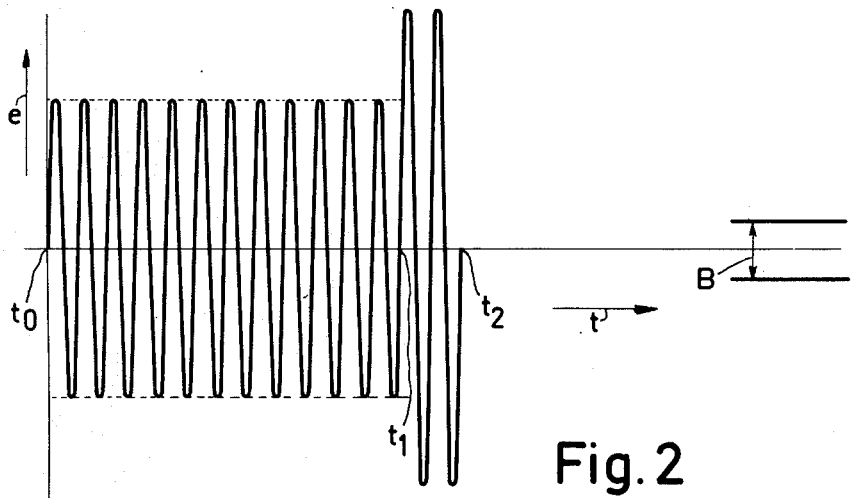

The invention will be further explained with reference to the drawing in which:

FIG. 1 shows an electric circuit of a device according to the invention together with a discharge lamp incorporated in that circuit; and FIG. 2 shows a graphic representation of the envelope of the voltage peaks between the electrodes of the lamp of FIG. 1 as a function of time.

In FIG. 1 terminals 1 and 2 are adapted for connection to an AC voltage source of 220V, 50 Hz. An inductive stabilization ballast 3 is connected to terminal 1. If desired a capacitive ballast consisting of a series circuit of a coil and a capacitor having a net capacitive character may also be used. The other side of ballast 3 is connected to a preheatable electrode 4 of a low-pressure mercury vapour discharge lamp 5. Reference 6 indicates a second preheatable electrode of lamp 5. Electrode 6 is connected to the input terminal 2. The ends of the electrodes 4 and 6 nearer to the input terminals 1 and 2 are interconnected by means of a capacitor 7. The other ends of the electrodes 4 and 6 are interconnected by means of a capacitor 8. In its turn this capacitor 8 is shunted by a series circuit of an inductor 9 and a diode bridge 10 to 13. This diode bridge comprises four center branches:

The first center branch comprises a series circuit of a resistor 20, a transformer winding 21 and the main electrodes of an NPN transistor 22. Another winding 23 of said transformer is connected between the base and the emitter of the transistor 22.

The second center branch of the diode bridge 10 to 13 comprises circuit of a resistor 24, a zener diode 25 and a capacitor 26. A node between the zener diode 25 and the capacitor 26 is connected to a resistor 27. The other side of resistor 27 is connected via a bidirectional breakdown element 28 to the base of the transistor 22. A resistor 29 is connected between the base and the emitter of the transistor 22. The junction between the resistor 27 and the breakdown element 28 is connected via a lead to the collector of an NPN-type auxiliary transistor 30. The emitter of this auxiliary transistor 30 is connected to the diodes 12 and 13 of the diode bridge.

A third center branch of the diode bridge comprises a series circuit of a resistor 31, a first diode 32, a zener diode 33 and a capacitor 34. The capacitor 34 is shunted by a resistor 35. Furthermore, the series circuit 32, 33,

35 is shunted by a series circuit composed of a resistor 36 in series with a parallel circuit of a capacitor 37 and a resistor 38.

A fourth center branch of the diode bridge 10 to 13 consists of a resistor voltage divider comprising a series circuit of a resistor 39 and a resistor 40. A node between the resistors 39 and 40 is connected to a diode 41. The other side of this diode is connected to a junction point between the diode 32 and the zener diode 33. The pass directions of the three diodes 32, 33 and 41 all point to their junction point.

Finally a node between the inductor 9 and diode 10 and a node between the diode 13 and the electrrode 6 are interconnected by means of a spike suppressor which is indicated by reference numeral 42.

The circuit described operates as follows. When the terminals 1 and 2 are connected to an AC voltage source of 22OV, 50Hz a current will flow when there is a sufficient instantaneous voltage between terminals 1 and 2, depending on the polarity of the AC voltage source, in the circuit 1, 3, 4, 9, 10, 24, 25, 26, 13, 6, to terminal 2 or in the circuit 2, 6, 11, 24, 25, 26, 12, 9, 4, 3 to terminal 1. When as a result of this current flow, the capacitor 26 is charged to a voltage such that the breakdown value of the breakdown- or threshold element 28 is exceeded the transistor 22 will become fully conductive by means of the transformer 21, 23. Consequently a current will start flowing in the first center branch of the diode bridge, namely in the branch 20, 21, 22. By means of this current the electrodes 4 and 6 of the lamp 5 are preheated. When this current has reached a constant value the drive for the transistor 22 is terminated. Owing to the known delay caused by the draining of charge carriers from the transistor, this transistor becomes non-conductive again a little later. While the transistor 22 is conducting, the capacitor 26 is partly discharged via the resistor 27, the threshold element 28 and the resistor 29. Owing to the fact that the transistor 22 becomes non-conductive the voltage across the capacitors 7 and 8 and consequently the voltage across the lamp 5 is raised. This is a rise in the voltage which is effected in about the same way as specified in the above mentioned British Patent Specification No. 3,208,489.

However, in the meantime the capacitor 37 is slightly charged via the resistors 31 and 36. When the voltage across capacitor 37 — perhaps after some half cycles of the supply voltage between the terminals 1 and 2 — has attained a certain, relatively large, value a current will thereafter periodically flow, from resistor 31 via diode 32 into the blocking direction of diode 33, which causes the auxiliary transistor 30 to start conducting, causing the series circuit of resistor 27 and capacitor 26 to be shortcircuited. This will of course lead to a partial discharge of the capacitor 26. So this actually opposes the charging of the capacitor 26 via resistor 24. Owing to this delay in the charging of the capacitor 26, the instants at which the transistor 22 is made conductive are delayed, so that on the one hand the circuit of the capacitor 7 and 8 and, on the other hand, the inductor 9 is closed somewhate later by the transistor 22. This results in a greater rise of the voltage across the two capacitors 7 and 8 and consequently to a corresponding voltage rise across lamp 5.

If the voltage between the lamp electrodes 4 and 6 would suddenly become very high, current will immediately flow via the voltage divider 39, 40 and the diode 41 into the blocking direction of the zener diode 33, which switches the transistor 30 very rapidly to the conducting state, thus preventing the transistor 22 from becoming further conducting. This is favourable because such a transistor should not be more conductive at such a high voltage at its main electrodes as this might have disastrous consequences for the transistor. The spike suppressor 42 is a further, additional protection for the starter.

In a practical embodiment, the value of the inductor 3 is approximately 1.2 Henry. The lamp 5 is a low-pressure mercury vapour discharge lamp of approximately 40 Watts. The capacitance value of the capacitor 7 is approximately 22 n Farad and that of capacitor 8 approximately 2.5 n Farad. The self-inductance of the inductor 9 is approximately 0.2 m Henry. The resistance of the resistor 20 is about 27 Ohm, that of resistor 24 about 18 kOhm, that of resistor 27 about 10 Ohm, that of resistor 29 about 100 Ohm, that of resistor 31 about 390 kOhm, that of resistor 35 about 10 kOhm, that of resistor 36 about 6.8 kOhm and that of resistor 38 about 150 kOhm. The resistor 39 has a resistance of about 100 kOhm and resistor 40 is about 3.9 kOhm. The capacitors 26, 34 and 37 have a capacitance of respectively 5.6 n Farad, 3.3 n Farad and 6,8$\mu$u Fared. The zener voltage of zener diode 33 is about 22 volts and that of zener diode 25 is about 150 volt. The breakdown voltage of the threshold element 28 is about 28 volts and the spike suppressor 42 responds at a voltage of about 680 V at 1 m Ampere.

The arrangement of the two capacitors 7 and 8 is also useful to protect the starter if an electrode of the lamp 5 fails during the starting procedure.

With the device described the lamp 5 was started without any flickering. A reliable ignition was obtained in the temperature range between $-°$ C and $+70°$ C.

If for some reason or another the lamp 5 refuses to ignite, the auxiliary transistor 30 blocks, after some time, the further operation of the starter, owing to the fact that then the voltage across the series circuit of the resistor 36 and the (capacitor 37) remains permanently above the zener voltage of the zener diode 33.

A great advantage of this device according to the invention is that the auxiliary transistor 30 also has a second function, namely it opposes, as described above, the charging of the capacitor 26, which enables the higher voltages between the lamp electrodes 4 and 6 during the starting procedure to be used.

By way of a further explanation the envelope of the instantaneous voltage $e$ between the electrode 4 and 6 if the lamp 5 of FIG. 1 is plotted as a function of the time $t$ in FIG. 2. Three cases will now be considered, namely:

a. a lamp 5 which is easy to start;
b. a lamp 5 which is difficult to start;
c. a lamp 5 which refuses to start.

Let us assume that the terminals 1 and 2 of FIG. 1 are connected to the supply source at an instant $t_0$. Until the instant $t_1$ only that part of the starter designated by 7 to 29 in FIG. 1 is in operation. This means that the auxiliary transistor 30, with its control circuit, has as yet no influence on the starting operation. The time from $t_0$ to $t_1$ is about 1.2 seconds. The peak voltage between the lamp electrodes is then about 500 V.

From the instant $t_1$ to $t_2$ the auxiliary transistor 30 is periodically switched to the conducting and the non-conducting state which results in an increased voltage between the lamp electrodes 4 and 6 as specified in the description of FIG. 1. The time from $t_1$ to $t_2$ is about 0.1 sec. The peak voltage between the lamp electrodes is then about 800 Volt.

After the instant $t_2$ the auxiliary transistor 30 blocks the operation of the starter. Then the supply voltage appears between the lamp electrodes.

When the lamp 5 ignites, the outlined starter procedure will be immediately interrupted and the voltage between the lamp electrodes 4 and 6 will immediately become equal to the operating voltage of the lamp. The starter is then not actuated by the action of the zener diode 25 whose threshold voltage (150V) is higher than the operating voltage (100V) of the lamp 5.

In the above mentioned case a of a lamp which is easy to ignite, the starting procedure is already interrupted between the instants $t_0$ and $t_1$. That means that the voltage between the lamp electrodes 4 and 6 will already be equal to the operating voltage B of the lamp (about 100V) at an instant between $t_0$ and $t_1$.

In the case *b* of a lamp which is difficult to ignite the starting procedure is interrupted between the instants $t_1$ and $t_2$.

In the case *c* of a lamp which refuses to ignite the voltage between the lamp electrodes follows the supply voltage (220 Volt) after the instant $t_2$. The auxiliary transistor 30 (see FIG. 1) is then permanently conductive so that no further starting efforts are made.

What is claimed is:

1. A device for starting and operating an electric discharge lamp provided with two electrodes comprising, two input terminals for connection to an AC voltage source whose frequency is less than 100Hz, means connecting a series circuit comprising at least a stabilizing inductor and the lamp across said two input terminals, means including a second inductor for interconnecting the two lamp electrodes by means of a starter comprising a branch circuit including a first semiconductor switching element, means connecting, in parallel with the branch which includes said semiconductor switching element, a control circuit for the first semiconductor switching element, said control circuit comprising at least a first capacitor, an auxiliary transistor shunting at least the first capacitor, a second control circuit comprising a first resistor and a second capacitor connected in series and in parallel to the branch including the first semiconductor switching element, means connecting the base of the auxiliary transistor via a voltage - sensitive threshold element to the junction of the first resistor and the second capacitor, and means connecting the lamp electrodes to a third capacitor.

2. A device as claimed in claim 1 wherein said interconnecting means includes a diode bridge connecting between the lamp electrodes and the first semiconductor switching element, the first semiconductor switching element being a transistor which is located in a center branch of said diode bridge.

3. A device as claimed in claim 2, characterized in that the voltage-sensitive threshold element comprises a first zener diode.

4. A device as claimed in claim 3, characterized in that the second control circuit comprises a series connection of, in this sequence, the first resistor, a first diode, the first zener diode and a fourth capacitor, the pass directions of the first diode and the zener diode being directed towards one another, the series circuit of the first diode, the first zener diode and the fourth capacitor being shunted by a series circuit including a second resistor and the second capacitor, the second capacitor and also the fourth capacitor each being shunted by a respective resistor.

5. A device as claimed in claim 4, characterized in that the second control circuit further comprises a non-capacitive voltage divider connected in parallel to the branch which includes the semiconductor switching element, and means connecting a tap of that voltage divider via a second diode to the junction of the first diode and the zener diode, the pass direction of the second diode being directed towards the last-mentioned junction.

6. A device as claimed in claim 1 further comprising a second voltage-sensitive threshold element connected in series with the first capacitor to form a branch which is connected in parallel to the first semiconductor switching element.

7. A circuit arrangement for starting and operating an electric discharge lamp having a pair of electrodes, said circuit comprising a pair of input terminals for applying a low frequency AC voltage to the circuit, a ballast impedance connected in series with said lamp across the input terminals, a semiconductor switching element, an inductor, means serially connecting the inductor and the switching element across the lamp electrodes, a first control circuit including a capacitor coupled to said switching element to initiate current flow therein, a transistor connected in shunt with the first capacitor, a second control circuit including a resistor and a second capacitor connected in series and coupled to a source of voltage, a voltage sensitive threshold element, means including said voltage sensitive element for coupling said second control circuit to a control electrode of said transistor to initiate current flow therein at an instant subsequent to the first initiation of current flow in the switching element thereby to delay the charging of the first capacitor and hence to vary the instant which current flow is initiated in the switching element during given half cycles of the AC voltage, and means connecting the lamp electrodes to a third capacitor.

8. A circuit arrangement as claimed in claim 7 wherein said second control circuit includes a resistive voltage divider connected across the switching element, a diode, and means including said diode and said voltage sensitive element for coupling a tap on said voltage divider to the transistor control electrode.

9. A circuit arrangement as claimed in claim 7 further comprising a diode, a second resistor, a fourth capacitor, said second control circuit comprising a series circuit including, in the order recited, the first resistor, the diode, the voltage sensitive element and the fourth capacitor, the part of the series circuit including the diode, the voltage sensitive element and the fourth capacitor being shunted by a series circuit that includes said second resistor and the second capacitor, third and fourth resistors, and means connecting said third and fourth resistors in shunt with said second and fourth capacitors, respectively.

10. A circuit arrangement as claimed in claim 7 further comprising a second voltage sensitive threshold element connected in series with the first capacitor to form a first control circuit that is connected in parallel to the semiconductor switching element.

11. A circuit arrangement as claimed in claim 7 wherein said means serially connecting the inductor and the switching element further comprises a diode bridge and said switching element comprises a second transistor connected across the output terminals of the diode bridge, and inductor and said third capacitor cooperating with said second transistor to supply voltage peaks across the lamp electrodes, during a starting procedure, that exceed in amplitude the AC voltage.

* * * * *

UNITED STATES PATENT AND TRADEMARK OFFICE

CERTIFICATE OF CORRECTION

PATENT NO. : 4,039,895

DATED : August 2, 1977

INVENTOR(S) : HUBERTUS M.J. CHERMIN ET AL

It is certified that error appears in the above-identified patent and that said Letters Patent are hereby corrected as shown below: IN THE TITLE PAGE Section [30] "7502005" should read --7502053--

Column 1, line 5, after "and/or" it should read --vapour--;

Column 4, line 18, after "voltage" it should read as follows:

--across the lamp. A further advantage of the second voltage- --;

Column 5, line 43, "3,208,489" should read --1,208,489--;

Column 6, line 23, "6,8μu Fared." should read --6.8μ Farad.--;

line 34, "- $^{o}$ C and +70$^{o}$ C." should read -- -20$^{o}$ C and +70$^{o}$ C.--;

UNITED STATES PATENT AND TRADEMARK OFFICE

CERTIFICATE OF CORRECTION

PATENT NO. : 4,039,895

DATED : August 2, 1977

INVENTOR(S) : HUBERTUS M.J. CHERMIN ET AL

It is certified that error appears in the above-identified patent and that said Letters Patent are hereby corrected as shown below:

Column 6, line 35, "another" should read --other--;

line 48, "electrode" should read --electrodes--;

Claim 11, line 6, after "bridge," "and" should read --said--;

Signed and Sealed this

*Tenth* Day of *October 1978*

[SEAL]

*Attest:*

RUTH C. MASON
*Attesting Officer*

DONALD W. BANNER
*Commissioner of Patents and Trademarks*